US006615005B2

(12) United States Patent
Maruyama

(10) Patent No.: US 6,615,005 B2
(45) Date of Patent: Sep. 2, 2003

(54) MOTOR DRIVING APPARATUS, IMAGE FORMING APPARATUS AND CONTROL METHOD THEREOF

(75) Inventor: Shoji Maruyama, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/839,369

(22) Filed: Apr. 23, 2001

(65) Prior Publication Data

US 2002/0003968 A1 Jan. 10, 2002

(30) Foreign Application Priority Data

Apr. 28, 2000 (JP) ..... 2000-129408

(51) Int. Cl.[7] ..... G03G 15/20
(52) U.S. Cl. ..... 399/67
(58) Field of Search ..... 399/67, 68, 69, 399/401, 402

(56) References Cited

U.S. PATENT DOCUMENTS 4,835,567 A * 5/1989 Ogata ..... 399/401
4,956,678 A * 9/1990 Kiya et al. ..... 399/124

FOREIGN PATENT DOCUMENTS

| | | | |
|---|---|---|---|
| JP | 57-138882 | * | 8/1982 |
| JP | 2-206392 | * | 8/1990 |
| JP | 8-202103 | * | 8/1996 |

* cited by examiner

*Primary Examiner*—Quana M. Grainger
(74) *Attorney, Agent, or Firm*—Fitzpatrick, Cella, Harper & Scinto

(57) ABSTRACT

It enables an image forming apparatus to switch back a recording medium without increasing costs and apparatus size. In order to do so, the image forming apparatus comprises a switchback unit for switching back the recording medium of which an image was recorded on one face, to record an image on the other face thereof, a DC blushless motor for driving the switchback unit, and a controller for performing operation control of the DC blushless motor, wherein the controller reversely rotates the DC blushless motor for a predetermined time after performing brake control of the DC blushless motor for a predetermined time, at predetermined timing.

24 Claims, 9 Drawing Sheets

MOTOR DRIVING APPARATUS, IMAGE FORMING APPARATUS AND CONTROL METHOD THEREOF

BACKGROUND OF THE INVENTION

1. Field of the Invention

The present invention relates to an image forming apparatus which performs printing on both faces of a recording medium, a control method for the image forming apparatus, and a storage medium.

2. Related Background Art

In recent years, an image forming apparatus which transfers yellow, magenta, cyan and black images on a sheet (a recording medium) in an electrophotographic process, fixes formed toner images to the sheet by a fixing roller, and then discharges the sheet to perform two-faced printing is widespread.

As shown in FIG. 6, in case of the two-faced printing by the image forming apparatus, for example, a transportation roller 326 is reversed after the trailing edge of the sheet passed a sheet discharge sensor 324, the sheet is thus switched back, and then the image is again formed on the back face of the sheet through a reverse rotation path 325.

FIG. 7 is a block diagram showing a control structure of the conventional image forming apparatus. Hereinafter, the control structure of the conventional image forming apparatus will be explained.

In FIG. 7, numeral 401 denotes a CPU which controls the image forming apparatus as a whole, and numeral 402 denotes a DC (direct current) brushless motor which drives a photosensitive drum for yellow (called a Y photosensitive drum). The DC brushless motor 402 drives each roller of an yellow (Y) cartridge 314, a Y photosensitive drum 306, and a transfer roller for yellow (called a Y transfer roller) 310 shown in FIG. 6.

Numeral 403 denotes a DC brushless motor which drives a photosensitive drum for magenta (called an M photosensitive drum). The DC brushless motor 403 drives each roller of a magenta (M) cartridge 315, an M photosensitive drum 307, and a transfer roller for magenta (called an M transfer roller) 311 shown in FIG. 6.

Numeral 404 denotes a DC brushless motor which drives a photosensitive drum for cyan (called a C photosensitive drum). The DC brushless motor 404 drives each roller of a cyan (C) cartridge 316, a C photosensitive drum 308, and a transfer roller for cyan (called a C transfer roller) 312 shown in FIG. 6. Numeral 405 denotes a DC brushless motor which drives a photosensitive drum for black (called a Bk photosensitive drum). The DC brushless motor 405 drives each roller of a black (Bk) cartridge 317, a Bk photosensitive drum 309, and a transfer roller for black (called a Bk transfer roller) 313 shown in FIG. 6.

Numeral 406 denotes a high voltage control circuit which applies a high voltage based on the electrophotographic process to the photosensitive drums, the cartridges, the transfer rollers and an electrostatic belt and controls the applied voltage. The high voltage control circuit 406 contains control circuits for four colors. Numeral 407 denotes a scanner control circuit which scans the photosensitive drum with a laser beam. Also, the scanner control circuit 407 contains control circuits for the four colors.

Numeral 408 denotes a fixing control circuit which controls a temperature of a fixing heater, and numeral 409 denotes a sheet discharge sensor. Numeral 410 denotes a DC brushless motor which drives the fixing roller and the electrostatic belt. Namely, the DC brushless motor 410 controls an electrostatic belt 305 and a fixing roller 322 shown in FIG. 6. Numeral 411 denotes a pulse motor which drives a sheet feed roller. Namely, the pulse motor 411 drives a sheet feed roller 303 shown in FIG. 6. Numeral 412 denotes a pulse motor which is used to perform the two-faced printing. Namely, the pulse motor 412 drives the transportation roller 326 shown in FIG. 6.

Numerals 413 and 414 denote driver (D/V) IC's for the pulse motors. Each of the D/V IC's 413 and 414 performs constant current control to flow a desired current in a desired excitation phase on the basis of an excitation signal supplied from the CPU.

Numeral 415 denotes an interface which communicates with a not-shown host computer.

As above, the color image forming apparatus includes the plural driving motors, and uses them according to an object. The respective motors are started, controlled and stopped by the control CPU.

FIG. 8 is a block diagram showing a circuit structure of the conventional DC brushless motor.

In FIG. 8, numeral 501 denotes a motor unit, numeral 502 denotes a control IC, and numeral 503 denotes a three-phase motor. Numeral 504 denotes a Hall sensor which detects a position of a main pole in a rotor. Numeral 505 denotes an FG sensor which detects a pattern adhered magnetically to the rotor, and outputs 36 pulses per one rotation of the motor.

Numeral 506 denotes an oscillator, numeral 507 denotes a current detection resistor, numeral 508 denotes a control unit, numeral 509 denotes a driver unit, numeral 510 denotes a current limiter detection unit, numeral 511 denotes a speed control unit, numeral 512 denotes a frequency divider, and numeral 513 denotes an integrating amplifier. Numerals 514 and 516 denote resistors which are integrating amplifier constants, and numerals 515 and 517 denote capacitors which are also integrating amplifier constants.

Numeral 518 denotes a control signal line which is used to drive and stop the motor from a not-shown microcomputer, and numeral 519 denotes a ready signal line which is activated when the number of rotations of the motor reaches a predetermined value. Further, a motor brake signal line is provided to supply a motor brake signal.

Next, an operation will be explained.

When a motor driving instruction is issued through the control signal line 518 by controlling the image forming apparatus, the control unit 508 detects the position of the main pole in the rotor of the three-phase motor 503 by using the Hall sensor 504, creates a three-phase excitation pattern to rotate the motor in a desired rotation direction, and transmits an excitation signal to a driver unit 509.

In response to the excitation signal, the driver unit 509 excites a not-shown output transistor to change the current direction for the coil of the three-phase motor 503 to obtain desired excitation. On the other hand, when the rotor of the three-phase motor 503 is rotated, a predetermined pulse is generated by the FG sensor 505, and the generated pulse is transferred to the speed control unit 511. The speed control unit 511 compares a reference clock generated by the oscillator 506 and the frequency divider 512 with the pulse detected by the FG sensor 505, and then outputs a difference obtained in the comparison.

The reference clock is set to be the object number of rotations of the motor. Namely, when the FG sensor outputs 30 pulses per one rotation of the motor, the reference clock only needs 600/60×30=300 Hz to rotate the motor by 600 rpm.

The difference from the object speed obtained by the speed control unit 511 is integrated by the integrating amplifier 513 and transferred to the driver unit 509. At this time, a gain and a phase compensation value are determined by the resistors 514 and 516 and the capacitors 515 and 517.

Such constants are called servo constants.

FIG. 9 is a timing chart showing switchback control timing in sheet feed, sheet transportation and two-faced printing of the conventional image forming apparatus.

In FIG. 9, numeral 601 denotes sheet feed motor driving timing, numeral 602 denotes photosensitive drum driving timing for each color, numeral 603 denotes fixing roller driving timing, numeral 604 denotes sheet discharge sensor output timing, and numeral 605 denotes reverse rotation motor driving timing.

First, when a printing start is triggered at a time 606, the photosensitive drum, the transfer roller, the cartridge driving roller and the electrostatic belt are driven at a time 607. Then, the sheet feed motor is driven at a time 608 to feed and transport the sheet.

After the sheet is transported, when a desired image forming operation ends, the leading edge of the sheet reaches the sheet discharge sensor, and this sensor detects the sheet at a time 609. On the other hand, when the sheet feed and transportation operation becomes unnecessary, the sheet feed motor is stopped at a time 610.

Next, when the trailing edge of the sheet passes the sheet discharge sensor, this sensor detects no sheet at a time 611. Then, a reverse rotation motor is driven at a time 612 to switch back the sheet. When the sheet is transported until a predetermined position at a time 613, the reverse rotation motor is stopped.

Then, when a next printing operation is instructed, an image is formed on the back face of the sheet, whereby the two-faced printing ends.

As described above, in the image forming apparatus which performs the two-faced printing, the reverse rotation motor dedicated to switch back the sheet is provided. Thus, when the trailing edge of the sheet is detected by the sensor, the sheet is switched back and transported by the reverse rotation motor.

Incidentally, in the conventional apparatus, the DC brushless motor capable of achieving high output and high efficiency is used to drive the units such as the photosensitive drum, a development roller acting as the cartridge driving roller, an electrification roller, the fixing roller and the like of which the load torque is relatively large. On the other hand, the pulse motor of low output and low cost is used to drive the units such as the sheet feed unit, the sheet transportation unit, the switchback unit for the twofaced printing, and the like of which the load torque is relatively small.

However, there is a problem that cost performance decreases by adding the pulse motor used only in two-faced printing. Further, there is a problem that a load of the power supply in the image forming apparatus increases because of increase in pulse motor driving power, and thus cost of the power supply unit increases.

As one of the methods to solve these problems, there is an idea that the fixing motor which is disposed at the position closest to the switchback unit is used combinedly for the switchback control. However, the load torque of the fixing motor is large, inertia is large because the DC brushless motor is used, and it takes time to switch back the sheet. Thus, when the forward rotation of the motor is changed to the reverse rotation to switch back the sheet, a distance necessary for the rotation change is long. For this reason, there is a problem that a transportation path length from the sheet discharge sensor to the reverse rotation roller is long, and thus the size of the apparatus is enlarged.

SUMMARY OF THE INVENTION

The present invention is made to solve the above problems, and an object thereof is to provide an image forming apparatus which attempts a decrease in cost and a high-speed switchback operation, a control method for the image forming apparatus, and a storage medium.

In order to achieve the above object, the present invention provides an image forming apparatus comprising:

- a switchback means for switching back a recording medium of which an image was recorded on one face, to record an image on the other face thereof;
- a DC brushless motor for driving the switchback means; and
- a control means for performing operation control of the DC brushless motor,
- wherein the control means reversely rotates the DC brushless motor for a predetermined time after performing brake control of the DC brushless motor for a predetermined time, at predetermined timing.

Further, the present invention provides a motor driving apparatus comprising:

- a control means for controlling driving of a DC brushless motor; and
- a setting means for setting a control value of the control means in accordance with a transportation condition of a recording medium,
- wherein the control means reversely rotates the DC brushless motor after performing brake control of the DC brushless motor for a predetermined period on the basis of the control value.

Further, the present invention provides a control method for an image forming apparatus which has a switchback mechanism for switching back by using a DC brushless motor a recording medium of which an image was recorded on one face, to record an image on the other face thereof, the method comprising:

- a step of performing brake control of the DC brushless motor for a predetermined time at predetermined timing; and
- a step of reversely rotating the DC blushless motor for a predetermined time.

Further, the present invention provides a driving method for a DC brushless motor, comprising:

- a control step of controlling driving of the DC brushless motor; and
- a setting step of setting a control value in the control step in accordance with a transportation condition of a recording medium,
- wherein the control step reversely rotates the DC brushless motor after performing brake control of the DC brushless motor for a predetermined period on the basis of the control value.

Other objects, features and effects of the present invention will become apparent from the following detailed description and the attached drawings.

DETAILED DESCRIPTION OF THE PREFERRED EMBODIMENTS

Hereinafter, the embodiments of the present invention will be explained with reference to the attached drawings.

Figure 6:
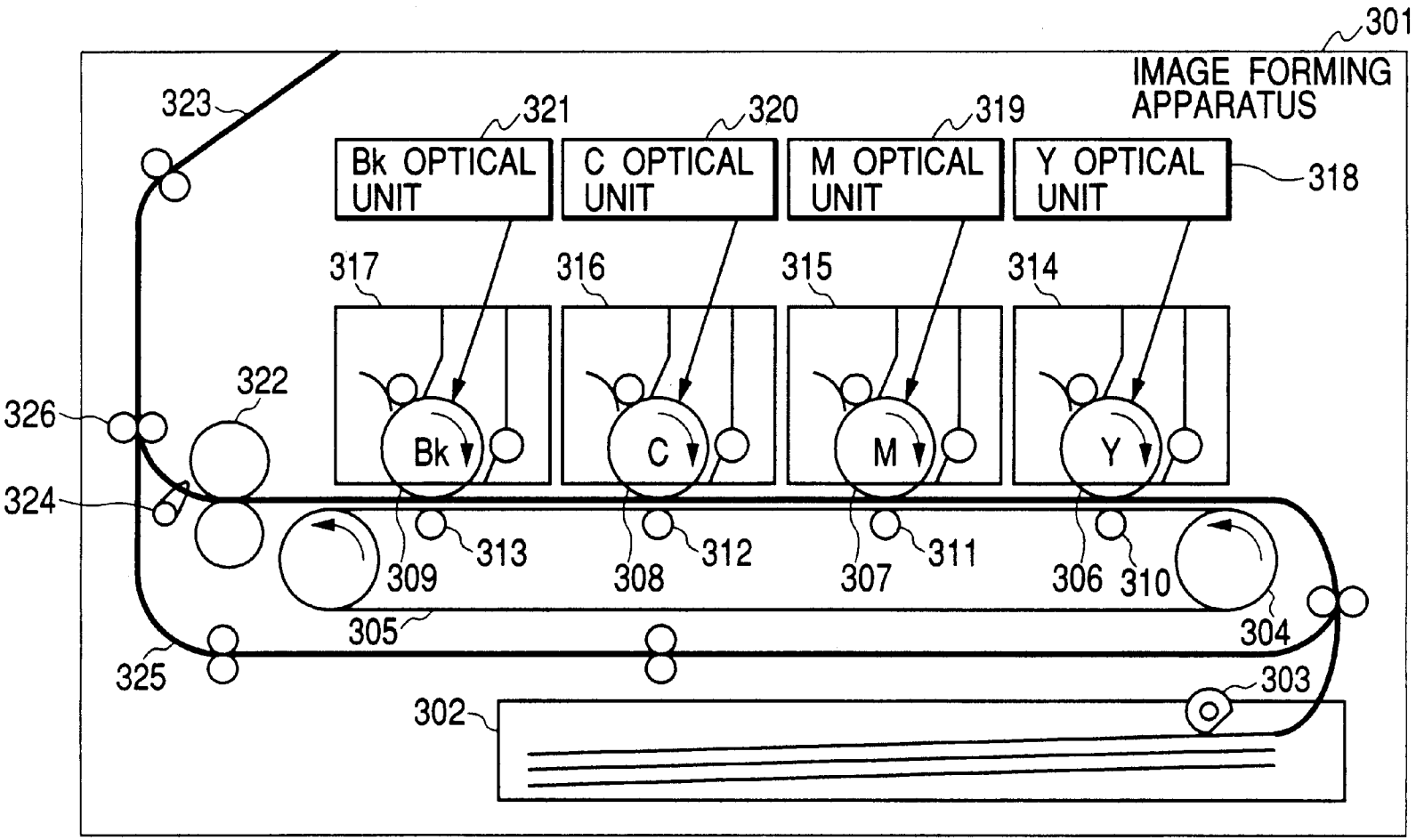
FIG. 6 is a sectional view showing a basic structure of the image forming apparatus according to the embodiments.
Figure 7:
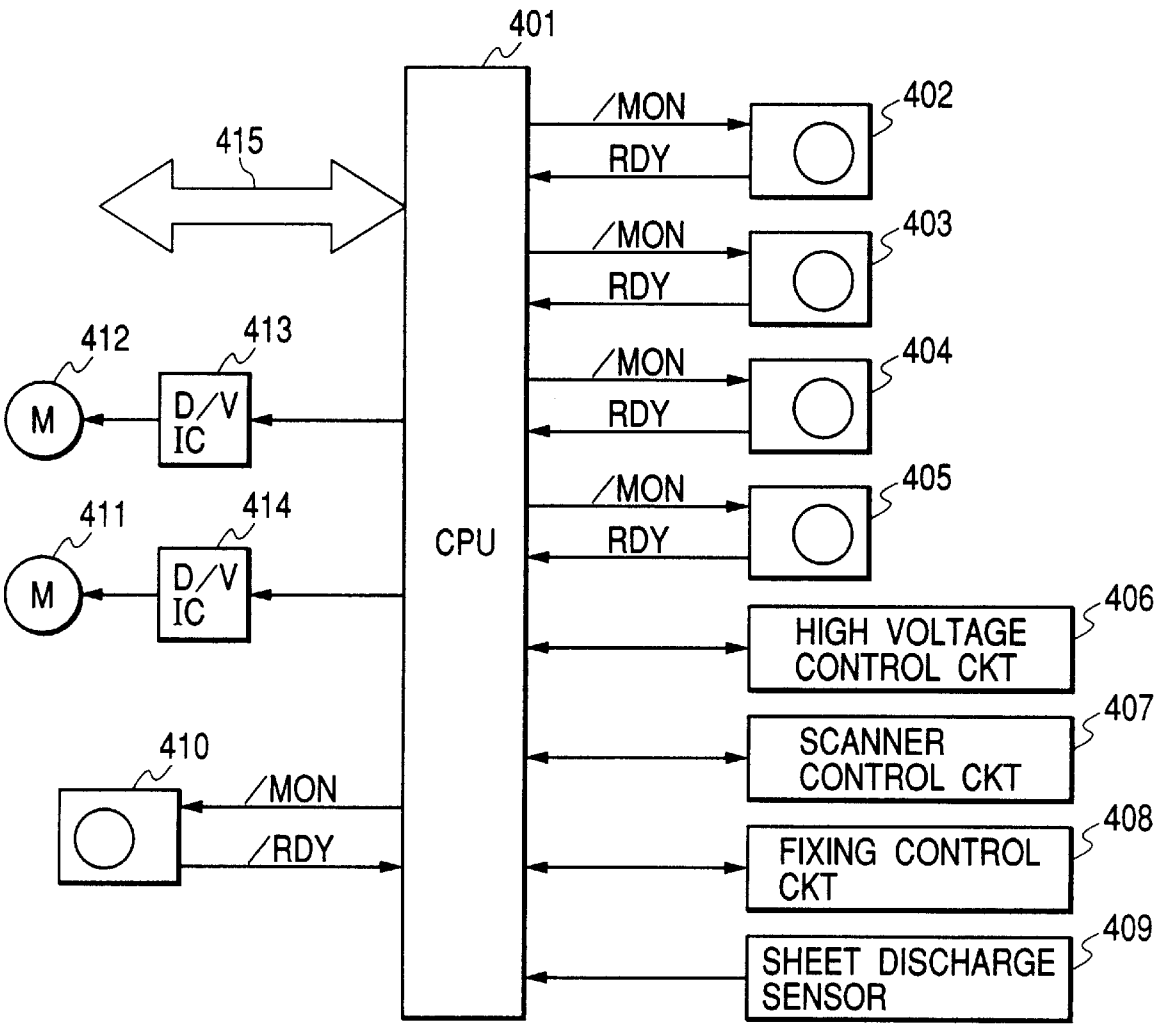
FIG. 7 is a block diagram showing a control structure of a conventional image forming apparatus.
Figure 8:
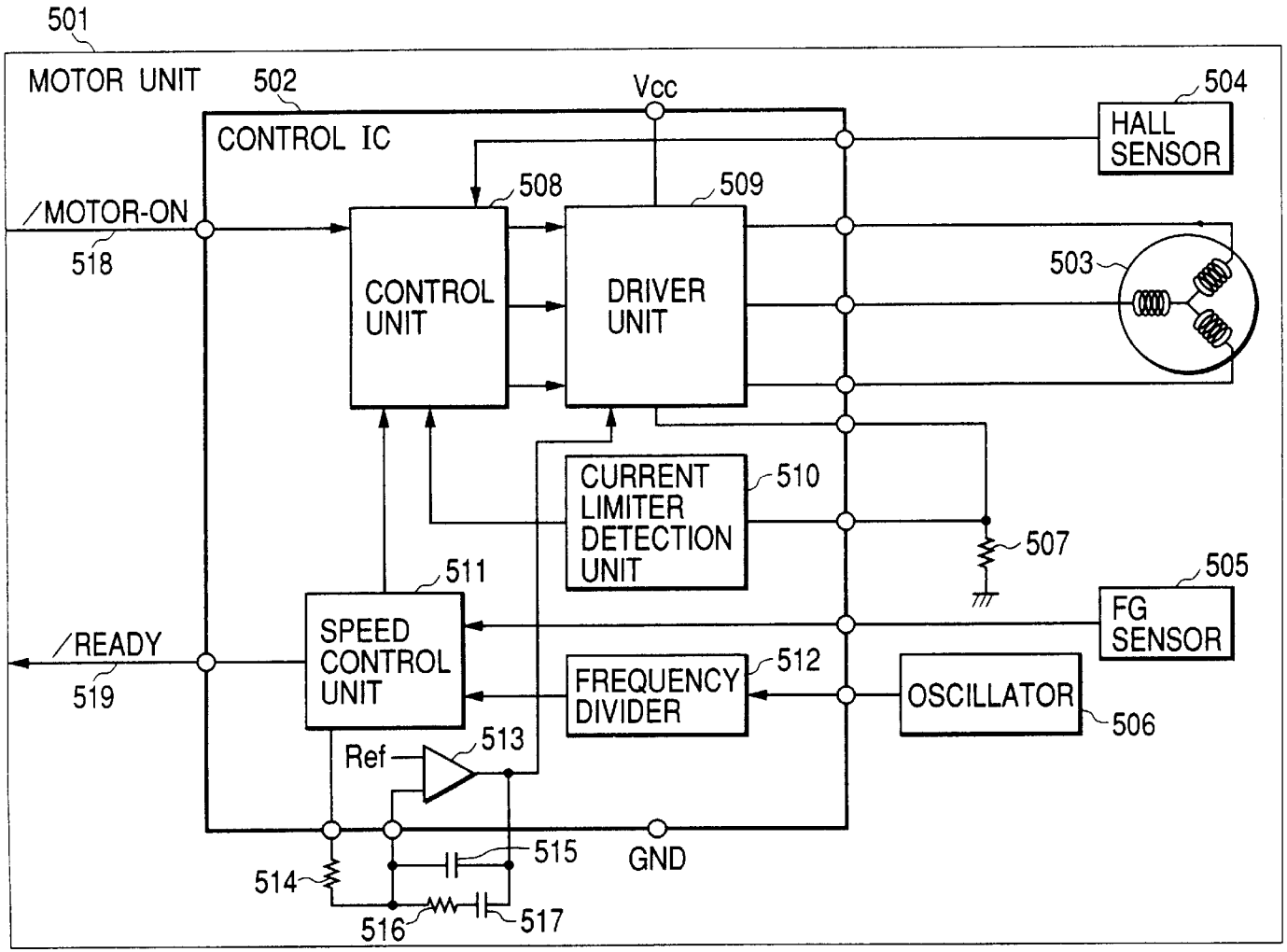
FIG. 8 is a block diagram showing a circuit structure of a conventional DC brushless motor.
Figure 9:
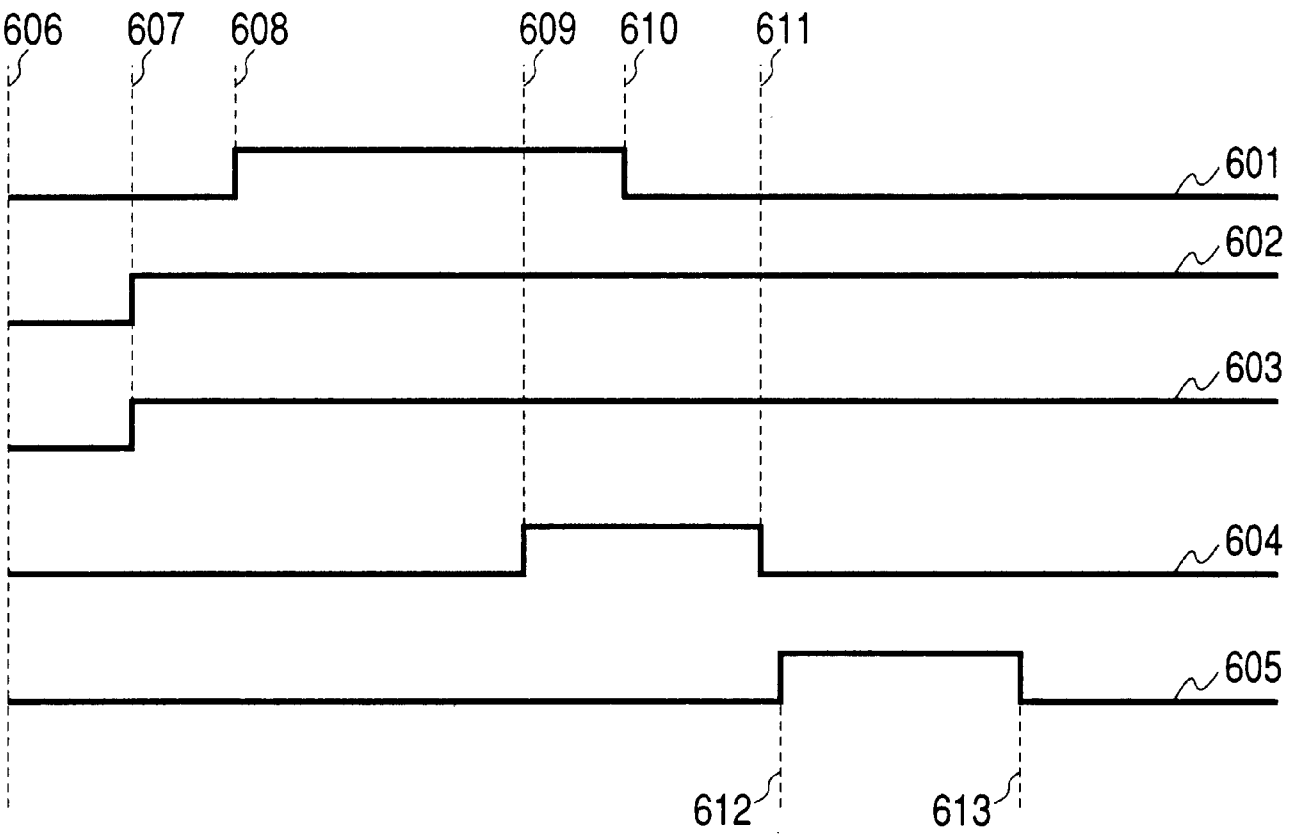
FIG. 9 is a timing chart showing timing of conventional switchback control.

FIG. 6 is a sectional view showing a basic structure of an image forming apparatus according to the embodiments.

In FIG. 6, numeral 301 denotes an image forming apparatus, numeral 302 denotes a sheet cassette, numeral 303 denotes a sheet feed roller which feeds a sheet (a recording medium) from the sheet cassette 302, and numeral 304 denotes a driving roller which drives an electrostatic belt 305.

Numeral 306 denotes a Y photosensitive drum, numeral 307 denotes an M photosensitive drum, numeral 308 denotes a C photosensitive drum, and numeral 309 denotes a Bk photosensitive drum. Further, numeral 310 denotes a Y transfer roller, numeral 311 denotes an M transfer roller, numeral 312 denotes a C transfer roller, and numeral 313 denotes a Bk transfer roller.

Numeral 314 denotes a Y cartridge, numeral 315 denotes an M cartridge, numeral 316 denotes a C cartridge, and numeral 317 denotes a Bk cartridge. Further, numeral 318 denotes a Y optical unit, numeral 319 denotes an M optical unit, numeral 320 denotes a C optical unit, and numeral 321 denotes a Bk optical unit.

Numeral 322 denotes a fixing roller which fixes to the sheet a toner image developed by the respective cartridges, numeral 323 denotes a sheet discharge path which is used to discharge the sheet to which the toner image was fixed by the fixing roller 322, numeral 324 denotes a sheet discharge sensor, numeral 325 denotes a reverse rotation path which is used to switch back the sheet in two-faced printing, and numeral 326 denotes a transportation roller which acts as a switchback means.

Hereinafter, motor control in the image forming apparatus having such the basic structure as above will be explained.

(First Embodiment)

Figure 1:
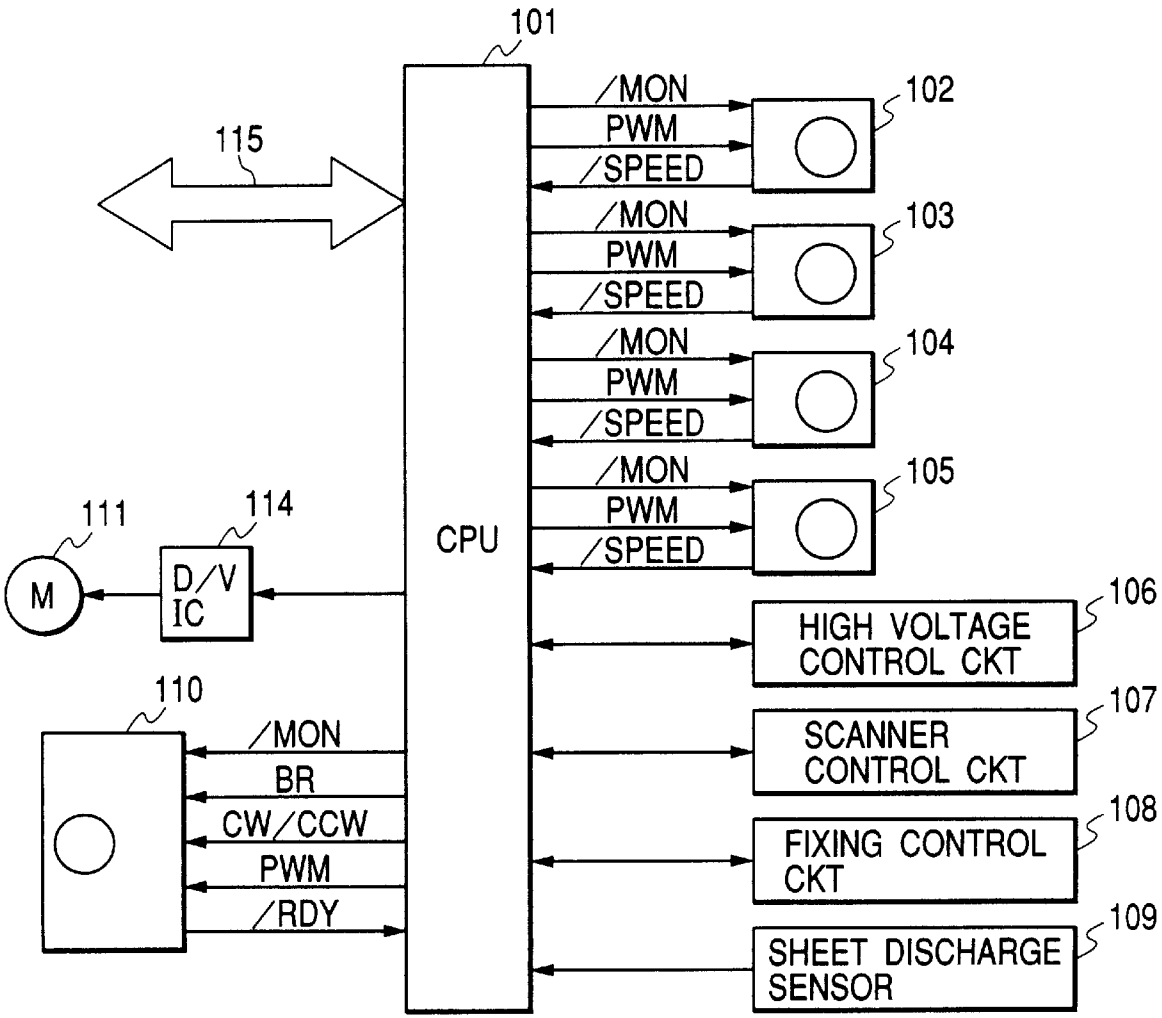
FIG. 1 is a block diagram showing a structure of a motor control circuit of an image forming apparatus according to the first embodiment.

FIG. 1 is a block diagram showing a structure of a motor control circuit of the image forming apparatus according to the first embodiment.

In FIG. 1, numeral 101 denotes a CPU which controls the image forming apparatus as a whole, and numeral 102 denotes a DC brushless motor which drives the Y photosensitive drum. Namely, the DC brushless motor 102 drives each roller of the Y cartridge 314, the Y photosensitive drum 306 and the Y transfer roller 310 shown in FIG. 6. Numeral 103 denotes a DC brushless motor which drives the M photosensitive drum. The DC brushless motor 103 drives each roller of the M cartridge 315, the M photosensitive drum 307 and the M transfer roller 311 shown in FIG. 6.

Numeral 104 denotes a DC brushless motor which drives the C photosensitive drum. The DC brushless motor 104 drives each roller of the C cartridge 316, the C photosensitive drum 308 and the C transfer roller 312 shown in FIG. 6. Numeral 105 denotes a DC brushless motor which drives the Bk photosensitive drum. The DC brushless motor 105 drives each roller of the Bk cartridge 317, the Bk photosensitive drum 309 and the Bk transfer roller 313 shown in FIG. 6.

Each of the DC brushless motors 102 to 105 is servo-controlled by the CPU 101. Thus, a speed signal "/SPEED" being a pulse signal to detect motor rotation speed is output from each motor to the CPU 101, and a PWM (pulse-width modulation) signal to control a motor current is output from the CPU 101 to each motor.

Numeral 106 denotes a high voltage control circuit, numeral 107 denotes a scanner control circuit, numeral 108 denotes a fixing control circuit, and numeral 109 denotes a sheet discharge sensor. Numeral 110 denotes a DC brushless motor which drives the fixing roller and the electrostatic belt, and performs switchback control. Namely, the DC brushless motor 110 performs brake control for the motor by a brake signal "BR", and can perform reverse rotation control for the motor by a control signal "CW/CCW". Numeral 111 denotes a pulse motor which drives the sheet feed roller. Numerals 114 denotes a driver (D/V) IC for the pulse motor 111.

As described above, in the image forming apparatus according to the present embodiment, the CPU 101 performs the servo control for the DC brushless motor. Particularly, the brake control signal and the reverse rotation control signal are input to the DC brushless motor for driving the fixing roller.

Next, the servo control for the DC brushless motor by the CPU 101 will be explained.

Figure 2:
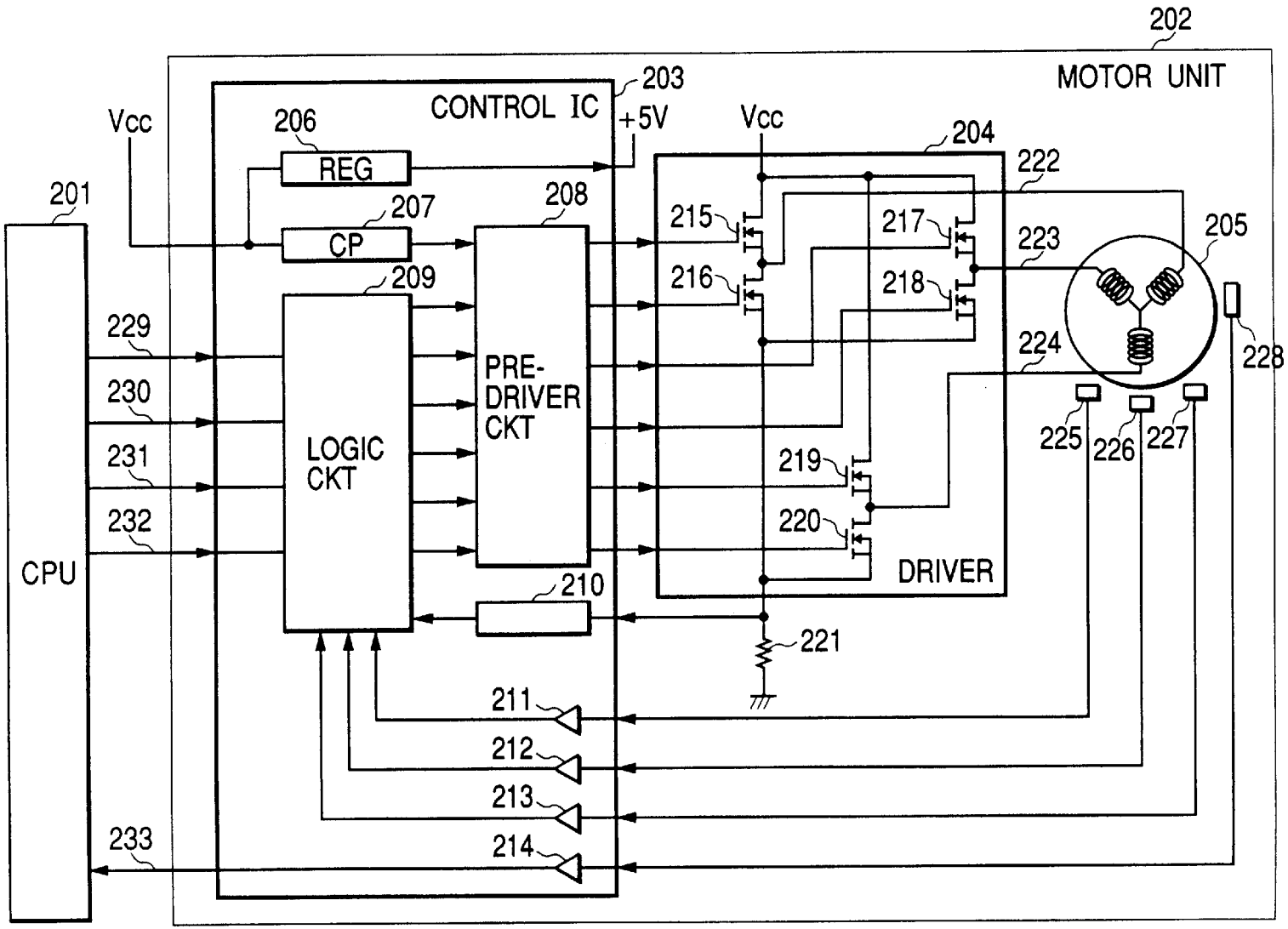
FIG. 2 is a block diagram showing structures of a DC brushless motor and a control circuit.

FIG. 2 is a block diagram showing structures of the DC brushless motor and the control circuit according to the first embodiment.

In FIG. 2, numeral 201 denotes a CPU, numeral 202 denotes a motor unit which includes a driving circuit, numeral 203 denotes a control IC, numeral 204 denotes a driver, numeral 205 denotes a three-phase DC brushless motor, and numeral 206 denotes a regulator (REG) which is included in the control IC 203. The REG 206 is the circuit which generates a +5V bias for a Hall sensor and an MR (magnetoresistive) sensor.

Numeral 207 denotes a charging pump (CP) circuit which generates a gate voltage for an n-channel metal-oxide semiconductor transistor (hereinafter called an NMOS transistor) of the driver, numeral 208 denotes a predriver circuit, numeral 209 denotes a logic circuit, numeral 210 denotes a current limiter circuit, numerals 211 to 213 denote Hall sensor amplifiers, numeral 214 denotes an MR sensor amplifier, numerals 215 to 220 denote NMOS transistors being the driver units, and numeral 221 denotes a current detection resistor.

Numeral 222 denotes a U-phase output line which is connected to a U-phase coil of the three-phase DC brushless motor 205, numeral 223 denotes a V-phase output line which is connected to a V-phase coil of the motor 205, and numeral 224 denotes a W-phase output line which is connected to a W-phase coil of the motor 205. Numerals 225 to 227 denote Hall sensors, and numeral 228 denotes an MR sensor.

Numeral 229 denotes a signal line which is used to transfer a motor start signal from the CPU 201 to the logic circuit 209, numeral 230 denotes a signal line which is used to transfer a PWM signal from the CPU 201 to the logic circuit 209, numeral 231 denotes a signal line which is used to transfer a brake signal from the CPU 201 to the logic circuit 209, and numeral 232 denotes a CW/CCW signal line which is used to transfer the control signal "CW/CCW" from the CPU 201 and is used in the reverse rotation control. Numeral 233 denotes a signal line which is used to transfer to the CPU 201 an MR sensor signal for detecting motor speed.

Next, an operation of the motor control will be explained.

First, the CPU 201 activates the signal line 229 to supply the motor start signal to the control IC 203 and generates a PWM pulse of on duty 80% to the signal line 230 for the PWM signal, whereby the motor is started.

The control IC 203 receives the start signal through the signal line 229. Then, in the logic circuit 209, excitation change of the NMOS transistors 215 to 220 is controlled based on the roller position detected by the Hall sensors 225 to 227 in order to obtain the predetermined rotation direction defined by the control signal "CW/CCW" received through the signal line 231. Further, the PWM signal is received through the signal line 230, whereby the NMOS transistors 215, 217 and 219 are subjected to PWM switching. At this time, the gate voltages of the NMOS transistors 215, 217 and 219 are increased up to Vcc +10V by the CP circuit 207.

For example, when the logic circuit 209 recognizes the rotor position of the motor by the Hall sensors 225 to 227 and the Hall sensors 211 to 213 and changes the current direction from the U-phase output line 222 to the V-phase output line 223 to obtain the desired rotation direction, the predriver 208 turns on the NMOS transistor 215, turns off the NMOS transistor 218 and turns off the NMOS transistors 216, 217, 219 and 220.

As a result, the current from the terminal Vcc flows to the current detection resistor 221 through the output lines 222 and 223, and the NMOS transistor 218, whereby magnetic force is generated on the predetermined coil. At this time, the PWM signal is supplied by the CPU 201 to the predriver 208 through the logic circuit 209, whereby the NMOS transistor 215 is PWM controlled by the predriver 208.

Therefore, the on-duty current defined by the PWM signal received through the current line 230 flows from the U phase to the V phase. Thus, the excitation change for changing the current flowing to the U, V and W phases of the motor is controlled to rotate the rotor in the predetermined direction, whereby torque is generated by electromagnetic interaction of not-shown magnet and coil.

When the motor 205 is subjected to the excitation change control and thus the rotor is rotated as above, an MR sensor magnetic adhesion pattern previously prepared is detected by the MR sensor 228, and 360 pulses are output per one rotation of the rotor. Namely, the signal having the frequency corresponding to the number of rotations of the motor is obtained, and the obtained signal is then transferred to the CPU 201 through the MR sensor amplifier 214 and the MR sensor signal line 223.

A program of the CPU 201 measures a pulse interval on the signal line 233 for the MR sensor signal, obtains a speed (rad/s) of the motor 205, compares the obtained speed with an object control speed, and performs a PI filter operation and a gain addition operation both not shown, whereby a PWM pulse width is derived. Further, the CPU 201 controls a current to be supplied to the motor 205 through the signal line 233 such that the motor 205 rotates at the object speed.

Next, the brake control will be explained.

When the brake control is performed to the rotatively driven motor 205, the CPU 201 activates the signal line 232 for the brake signal. The control IC 203 which received the brake signal stops the excitation change control for the motor 205, whereby the current is flowed only in the specific phase of the motor 205.

For example, when the signal line 232 is activated and thus the brake signal is supplied, the NMOS transistors 215 and 220 are turned on, the excitation pattern is maintained to flow the currents of the motor 205 in the certain directions on the output lines 222 to 224. A quantity of the current is determined according to duty of the PWM signal on the signal line 230. Thus, the motor 205 applies the brakes, whereby a time to stop the rotation is shortened as compared with a state that the motor is stopped by turning off all the transistors.

Thus, the CPU (control means) 201 performs the switching of the NMOS transistors at the output stage by using the PWM signal and thus performs the servo control such that the motor is rotated at the desired number of rotations. On the other hand, the control IC 203 performs the excitation control on the basis of the result obtained by detecting with the Hall sensors 225 to 227 the position of the main pole in the rotor, such that the rotor is rotated in the rotation direction indicated by the CPU 201. The control IC 203 also drives the NMOS transistors. Further, a protection circuit is provided. Namely, the current flowed in the motor is detected by the current detection resistor 221. When the current of which the quantity exceeds a predetermined level is detected, such the current is limited by the current limiter circuit 210.

Further, when the brake control is instructed by the CPU 201, the control IC 203 performs the brake control to not perform the excitation change but maintain the excitation pattern so as to flow the current only in the specific phase of the motor.

The image forming apparatus has, in total, the five motor units such as the above-explained DC brushless motor 205 to drive the photosensitive drum and the fixing roller. In these motor units, since the brake signal "BR" and the control signal "CW/CCW" can be input to the DC brushless motor 110 for driving the fixing roller, the brake control and rotation direction change control can be performed for this motor 110.

Next, the two-faced printing control will be explained.

Figure 3:
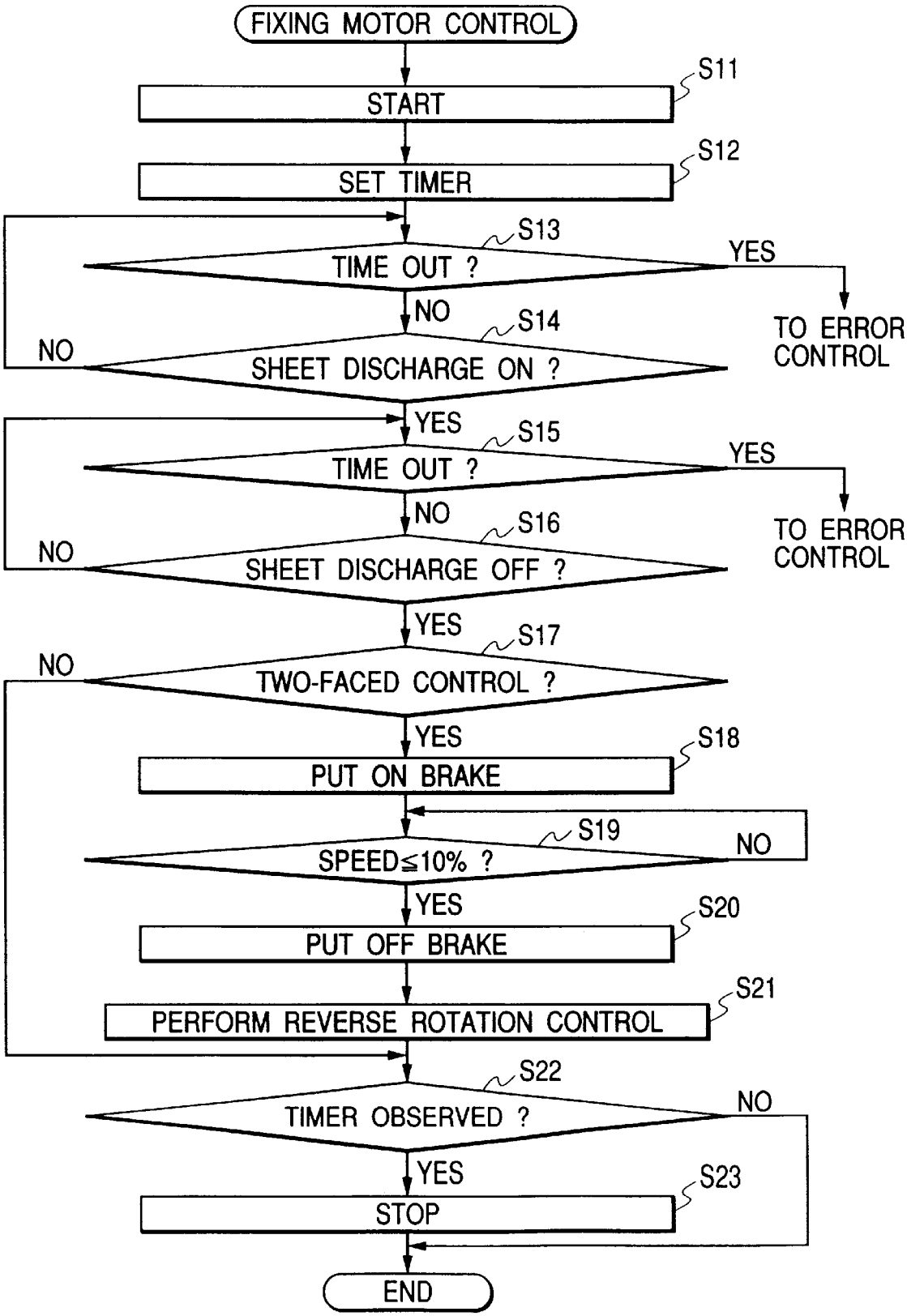
FIG. 3 is a flow chart showing a control operation in case of two-faced printing according to the first embodiment.
Figure 4:
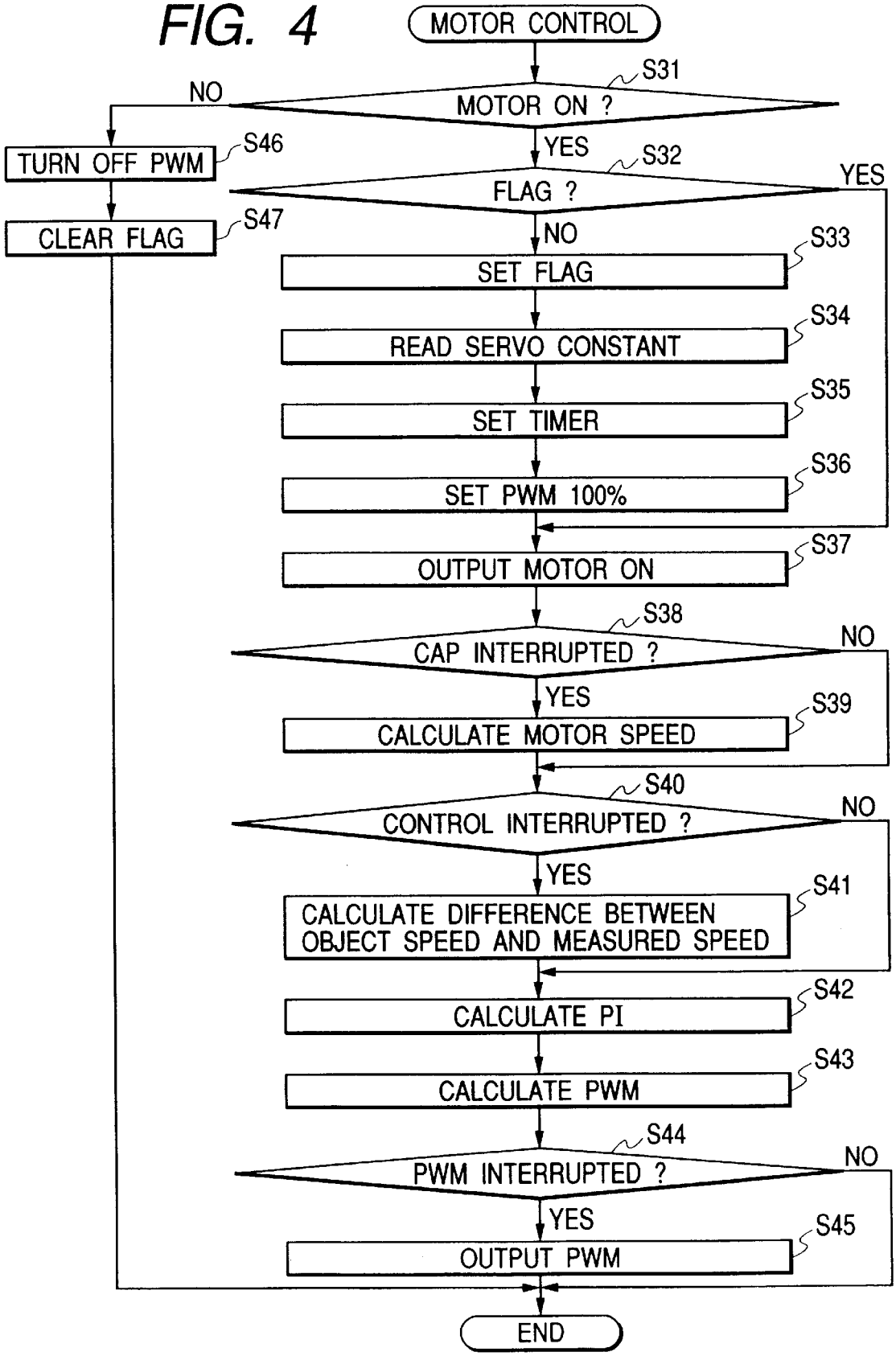
FIG. 4 is a flow chart showing a control operation in case of the two-faced printing according to the first embodiment.

FIGS. 3 and 4 are flow charts showing a control operation in case of performing the two-faced printing control according to the first embodiment. In other words, FIGS. 3 and 4 show the control flow of the fixing roller driving motor. It should be noted that the operations indicated by the flow charts of FIGS. 3 and 4 are performed based on a program stored in a not-shown ROM, in accordance with instructions issued from the CPU 101 (CPU 201).

FIG. 3 is the flow chart showing the fixing motor control, and FIG. 4 is the flow chart showing the motor control subroutine.

In a step S11 of FIG. 3, the fixing motor is started such that the motor rotates in the predetermined rotation direction, and in a step S12, a not-shown timer is set. Then, it is judged in a step S14 by the sheet discharge sensor whether or not a sheet exists, and in a step S13 the timer is monitored. If it is judged that the sheet does not exist for a predetermined time, the flow jumps to error control. Conversely, if it is judged that the sheet exists, it is considered that the leading edge of the sheet reached the sheet discharge sensor, and the flow advances to a step S16 to judge whether or not the sheet still exists in the sheet discharge sensor.

In a step S15, the timer is monitored. If it is judged that the sheet does not exist for a predetermined time, the flow jumps to the error control. Conversely, if it is judged by the sheet discharge sensor that the sheet does not exist, it is considered that the trailing edge of the sheet passed the sheet discharge sensor.

Next, it is confirmed in a step S17 whether or not two-faced printing is instructed. If confirmed that the two-faced printing is instructed, the sheet is switched back. In order to do so, the brake control is first performed to the motor in a step S18, and if it is judged in a step S19 that the motor speed becomes 10% or less, the brake is turned off in a step S20. Then, in a step S21, the control signal "CW/CCW" explained in FIG. 2 is changed to reverse the rotation direction.

By such the control, the sheet is switched back after it passed the sheet discharge sensor.

In a step S22, the timer is monitored, and in a step S23 the motor is stopped after a predetermined time elapsed.

Next, the motor control subroutine will be explained with reference to FIG. 4.

The motor control is structured by tasks, and executed every time the task is read from a not-shown main routine. First, it is judged in a step S31 whether or not a motor start request is issued. If judged that the motor start request is issued, a motor operating flag which indicates that the motor is operating is confirmed in a step S32.

Conversely, if judged that the motor is not started, the flag is set in a step S33, and in a step S34 a servo constant is read from a look-up table. In a step S35, the timer is set, and in a step S36, the PWM signal is set to have the value of 100%, in order to set the PWM value at the start time maximum. In a step S37, a motor-on signal is generated, whereby the signal on the signal line 229 of FIG. 2 becomes on. Then, in a step S38, the flow waits for interruption of capture. The capture is connected to the speed signal on the signal line 233 of FIG. 2, whereby a pulse time width of the speed signal is measured.

Next, in a step S39, the motor speed is calculated, and in a step S40 the flow waits for interruption of control. For example, the interruption of control is executed at a cycle of 1 KHz which is the cycle determined from a motor speed response and the like. In a step S41, a difference between an object speed and an actually measured speed is calculated, and in a step S42 the PI filter operation is performed based on the previously set servo constant (control value). The constant term and the integration term at this time are used as the servo constant.

Then, in a step S43, a value corresponding to the PWM width is produced, in a step S44 the flow waits for interruption at a previously set PWM carrier cycle, and in a step S45 the PWM signal is output. For example, if the PWM interruption cycle is set to 20 KHz, the PWM signal of the carrier cycle 20 KHz can be output. On the other hand, if the motor stop is instructed, the PWM signal is set to have the value "0" in a step S46, the flag is cleared in a step S47, and the process ends.

As described above, according to the present embodiment, in the DC brushless motor for driving the fixing roller, it causes the CPU to perform the servo control, the brake control for the motor, and the reverse rotation control for the motor. Thus, even if the DC brushless motor which is used to drive the fixing roller is also used to drive a reverse rotation roller for the two-faced printing operation, the distance necessary to switch back the sheet can be shortened, whereby the apparatus can be downsized as a whole. Further, high-speed switchback control can be achieved.

(Second Embodiment)

Figure 5:
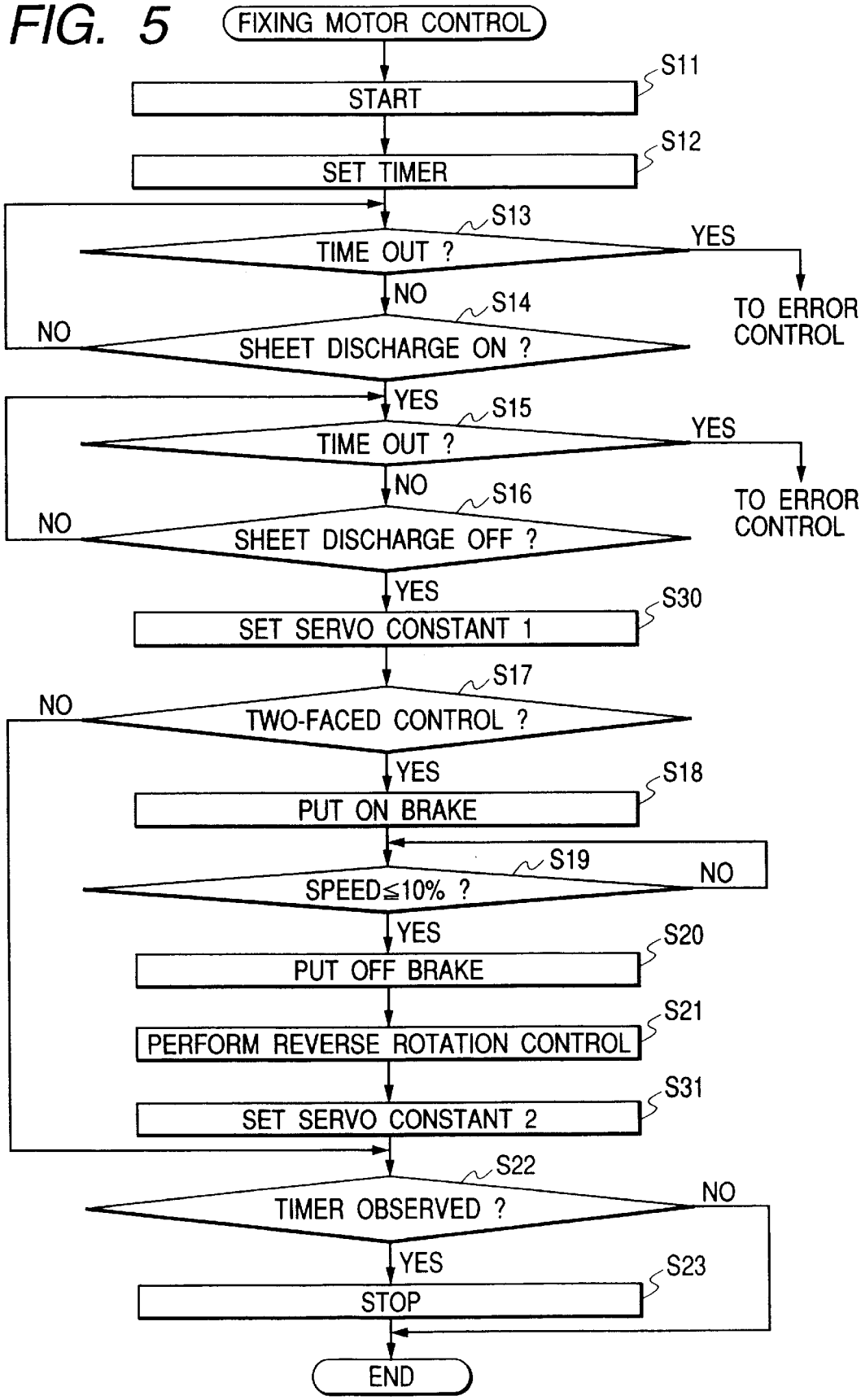
FIG. 5 is a flow chart showing a control operation in case of two-faced printing according to the second embodiment.

FIG. 5 is a flow chart showing a control operation in case of the two-faced printing according to the second embodiment. In the second embodiment, since the structure of the apparatus is the same as that in the first embodiment, the explanation thereof will be omitted.

In the present embodiment, the flow of the fixing motor control explained in the first embodiment is modified. Namely, as shown in FIG. 5, a servo constant (1) which is set by the CPU (setting means) in the ordinary printing (step S30) is made different from a servo constant (2) which is set when the switchback control is performed in the two-faced printing (step S31). In other words, the feature of the present embodiment is to make the servo constant (i.e., the control value) different according to the sheet transportation condition.

When the two-faced printing is performed, only the reverse rotation roller (the transportation roller 326) is driven by the motor 110, and the fixing roller 322 is not driven. Thus, for example, if a one-way clutch is used, a motor driving load may be relatively light.

On the other hand, when the ordinary printing is performed, the fixing roller 322 of which the load is relatively heavy is driven. Therefore, when the servo constant of the motor is fixed in this case, the stable control can not be performed, whereby there is a problem that irregular rotation deteriorates.

In order to solve such the problem, according to the present embodiment, the optimum servo constant is used according to the kind of control. Thus, the stable switchback control can be achieved.

(Third Embodiment)

The feature of the present invention is to apply a fixing temperature adjustment function in a case where the switchback control is performed. Namely, the fixing temperature adjustment function is the function to once stop temperature adjustment of the fixing unit while the brake control for the motor is being changed to the reverse rotation control for the motor. Particularly, in the image forming apparatus which performs on-demand fixing, when the fixing roller 322 is stopped, temperature rises rapidly, whereby abnormality is brought to the image forming apparatus.

Therefore, in the present embodiment, in the case where the switchback control is performed when the twofaced printing is performed, the heater control by the fixing control circuit (i.e., adjustment means) 108 is once stopped. Thus, the image forming apparatus which is safe and highly reliable in the control can be provided.

(Fourth Embodiment)

It was explained in the above first to third embodiments that the motor is servo-controlled.

However, in order to drive and control plural motors in higher accuracy, if a DSP (digital signal processor) is applied, steadier servo control can be achieved because of an excellent calculation process. In this case, it is needless to say that, even if the servo control is performed by using the DSP, the same effect as above can be obtained.

In the image forming apparatus which performs the two-faced printing, a DC brushless motor by which high efficiency and high output can be obtained is applied to drive the fixing roller and also to drive the reverse rotation roller (transportation roller) for switching back the sheet used in the two-faced printing. Further, the DC brushless motor is servo-controlled by the CPU or the DSP so as to perform the brake control and the reverse rotation control for the motor, and set the servo constant according to a control condition (i.e., a transportation condition including a sheet transportation speed). Thus, the costs of the image forming apparatus can be decreased, the power consumption thereof can be decreased, and the high-speed switchback can be achieved. Namely, the distance necessary to switch back the sheet can be shortened, whereby the apparatus can be downsized as a whole.

Further, by controlling the temperature of the fixing unit in accordance with the motor control, reliability of the image forming apparatus can be increased.

It should be noted that the present invention can be executed as a storage medium which stores a program to achieve the above switchback control.

(Fifth Embodiment)

The brake control explained as above is the control method of flowing the current in the specific phase of the motor.

However, it is possible to perform so-called short brake control which turns on all the NMOS transistors on the lower side only after the output.

The logic of the short brake control is simple. Namely, for example, when the NMOS transistors 215, 217 and 219 are turned off and the NMOS transistors 216, 218 and 220 are turned on, all the phases of the motor are grounded, whereby the short brake control is performed.

According to the above embodiments of the present invention, the costs can be decreased, and the high-speed switchback can be achieved. Namely, the distance necessary to switch back the sheet can be shortened, whereby the apparatus can be downsized as a whole.

Although the present invention has been explained by use of the several preferred embodiments, the present invention is not limited to these embodiments. Namely, it is obvious that various modifications and changes are possible in the present invention without departing from the spirit and scope of the appended claims.

What is claimed is:

1. An image forming apparatus comprising:

switchback means for switching back a recording medium of which an image was recorded on one face, to record an image on the other face thereof;

a DC brushless motor for driving said switchback means; and control means for performing switchback operation to reversely rotate said DC brushless motor after brake control of said DC brushless motor by supplying a current to a specific phase of said DC brushless motor.

2. An apparatus according to claim 1, wherein a servo control value of said DC brushless motor is set according to a transportation speed of the recording medium by a fixing unit.

3. An apparatus according to claim 2, wherein a control value in an acceleration period after said DC brushless motor was reversely rotated by said control means is different from a control value after the number of rotations of said DC brushless motor reached a predetermined number.

4. An apparatus according to claim 1, wherein a fixing unit and said switchback means are driven by said one DC brushless motor.

5. An apparatus according to claim 4, further comprising adjustment means for adjusting a temperature of a fixing heater of said fixing unit, wherein, during a predetermined period in case of switching back the recording medium, said fixing heater is temporarily turned off.

6. An apparatus according to claim 1, wherein said control means changes a control value according to a temperature condition of a fixing heater.

7. An apparatus according to claim 1, wherein said control means changes a control value according to a transportation speed of the recording medium.

8. A control method for an image forming apparatus which has a switchback mechanism for switching back by using a DC brushless motor a recording medium of which an image was recorded on one face, to record an image on the other face thereof, said method comprising:

a step of performing switchback operation to reversely rotate the DC brushless motor after brake control of the DC brushless motor by supplying a current to a specific phase of the DC brushless motor.

9. A method according to claim 8, wherein a servo control value of the DC brushless motor is set according to a transportation speed of the recording medium by a fixing unit.

10. A method according to claim 9, wherein a control value in an acceleration period after the DC brushless motor was reversely rotated is different from a control value after the number of rotations of the DC brushless motor reached a predetermined number.

11. A method according to claim 8, wherein a fixing unit and the switchback mechanism are driven by one DC brushless motor.

12. A method according to claim 11, wherein, during a predetermined period in case of switching back the recording medium, a fixing heater of the fixing unit is temporarily turned off.

13. A method according to claim 8, wherein a control value is changed according to a temperature condition of a fixing heater.

14. A method according to claim 8, wherein a control value is changed according to a transportation speed of the recording medium.

15. A driving method for a DC brushless motor, comprising:

a control step of controlling driving of the DC brushless motor; and a setting step of setting a control value in said control step in accordance with a transportation condition of a recording medium, wherein said control step reversely rotates the DC brushless motor after performing brake control of the DC brushless motor for a predetermined period on the basis of the control value.

16. An image forming apparatus comprising:

switchback means for switching back a recording medium of which an image was recorded on one face to record an image on the other face thereof, a fixing unit for fixing an image on said recording medium, a motor for driving said switchback means and fixing unit, motor control means for performing switchback operation to reversely rotate said motor after brake control of said motor, and fixing control means for temporarily suppressing a fixing heater of said fixing unit during a predetermined period within said switchback operation.

17. An apparatus according to claim 16, wherein said motor is a DC brushless motor.

18. An image forming apparatus comprising:

switchback means for switching back a recording medium of which an image was recorded on one face to record an image on the other face thereof;

a DC brushless motor for driving said switchback means; and control means for performing switchback operation to reversely rotate said DC motor after brake control of said DC brushless motor by grounding all phases of said DC brushless motor.

19. An apparatus according to claim 18, wherein a servo control value of said DC brushless motor is set according to a transportation speed of the recording medium by a fixing unit.

20. An apparatus according to claim 19, wherein a control value in an acceleration period after said DC brushless motor was reversely rotated by said control means is different from a control value after the number of rotations of said DC brushless motor reached a predetermined number.

21. An apparatus according to claim 18, wherein a fixing unit and said switchback means are driven by said DC brushless motor.

22. An apparatus according to claim 21, further comprising adjustment means for adjusting a temperature of a fixing heater of said fixing unit, wherein, during a predetermined period in case of switching back the recording medium, said fixing heater is temporarily turned off.

23. An apparatus according to claim 18, wherein said control means changes a control value according to a temperature condition of a fixing heater.

24. An apparatus according to claim 18, wherein said control means changes a control value according to a transportation speed of the recording medium.

* * * * *

UNITED STATES PATENT AND TRADEMARK OFFICE

CERTIFICATE OF CORRECTION

PATENT NO. : 6,615,005 B2
DATED : September 2, 2003
INVENTOR(S) : Shoji Maruyama It is certified that error appears in the above-identified patent and that said Letters Patent is hereby corrected as shown below:

Column 1,
Line 34, “an” should read -- a --.

Column 3,
Line 51, “twofaced” should read -- two-faced --.
Line 58, “increase” should read -- an increase --.

Column 4,
Line 46, “blushless” should read -- brushless --.

Column 6,
Line 28, “Numerals 114” should read -- Numeral 114 --.

Column 11,
Line 55, “reached” should read -- reaches --.

Column 12,
Line 19, “reached” should read -- reaches --.

Column 13,
Line 11, “reached” should read -- reaches --.

Signed and Sealed this

Twenty-third Day of December, 2003

JAMES E. ROGAN
*Director of the United States Patent and Trademark Office*